United States Patent [19]

Hendrickson

[11] Patent Number: 4,798,637

[45] Date of Patent: Jan. 17, 1989

[54] COMPOSITE SOLID PROPELLANTS CONTAINING BITETRAZOLES

[75] Inventor: Roger R. Hendrickson, Bear River City, Utah

[73] Assignee: Morton Thiokol, Inc., Chicago, Ill.

[21] Appl. No.: 471,618

[22] Filed: Mar. 3, 1983

[51] Int. Cl.[4] ..... C06B 45/08

[52] U.S. Cl. ..... 149/20; 149/21; 149/38; 149/42; 149/44; 149/76; 149/92; 149/110; 149/113

[58] Field of Search ..... 149/20, 21, 38, 42, 149/44, 76, 92, 110, 113

[56] References Cited

U.S. PATENT DOCUMENTS

| | | | |
|---|---|---|---|
| 4,180,424 | 12/1979 | Reed et al. | 149/19.91 |
| 4,239,073 | 12/1980 | Reed et al. | 149/19.91 |
| 4,369,079 | 1/1983 | Shaw | 149/2 |
| 4,370,181 | 1/1983 | Lundstrom et al. | 149/2 |

*Primary Examiner*—Stephen J. Lechert, Jr.

[57] ABSTRACT

Composite solid propellants are provided containing, in an amount effective to reduce the burning rate of the propellant, at least one bitetrazole compound.

4 Claims, No Drawings

COMPOSITE SOLID PROPELLANTS CONTAINING BITETRAZOLES

BACKGROUND OF THE INVENTION

Composite solid propellants commonly comprise one or more solid inorganic or organic oxidizer materials uniformly dispersed in a matrix of plastic, resinous or elastomeric material. The matrix, also known as the "binder", provides fuel for the combustion of the propellant. While the oxidizer material generally comprises the major constituent of the composite solid propellant, such propellants often contain (in addition to the binder) fuels, such as metal powders, and solid and/or liquid additives to enhance the ballistic and/or physical performance of the propellant.

In some applications, it is desirable to reduce the burning rate of the composite solid propellant. For example, the thrust provided by the burning propellant can be provided, for a given amount of propellant, over a longer period of time with a relatively slow burning propellant than with one which burns at a comparatively rapid rate, i.e. the given amount of propellant will be consumed faster at the high burning rate than at the reduced burning rate. Unfortunately, achieving these reduced burning rates without sacrificing other properties of the composite solid propellant, such as its specific impulse or efficiency of fuel combustion, has been difficult if not impossible. Particularly in the case of composite solid propellants which employ ammonium perchlorate (AP) as the oxidizer, attempts to reduce the burning rate of the propellant while maintaining its other properties have met with limited success.

Generally, the methods employed for reducing the burning rate of AP-containing composite solid propellants which do not result in a reduction in specific impulse have been limited to the use of large particle size AP. However, there is a limit to the larger AP size which can be employed in the composite solid propellant and still obtain efficient combustion of the metal powder fuels which are commonly utilized in such propellants. The burning rate of AP-containing composite solid propellants has also been reduced by increasing the binder content of the propellant, but this causes a significant decrease in both propellant density and fuel combustion efficiency. Increasing the metal fuel content likewise reduces the burning rate, but reduces the fuel combustion efficiency. Finally, many additives have proven to reduce the burning rate of AP-containing composite solid propellants, but usually specific impulse, fuel combustion efficiency or both must be sacrificed.

SUMMARY OF THE INVENTION

It has now been discovered that bitetrazole compounds reduce the burning rate of ammonium perchlorate-containing composite solid propellants while quite unexpectedly providing an increase in specific impulse and not significantly altering fuel combustion efficiency.

Thus, in accordance with this invention, there is provided an improved composite solid propellant containing, in an amount effective to reduce the burning rate of said propellant, at least one bitetrazole compound.

DETAILED DESCRIPTION OF THE PREFERRED EMBODIMENT

The improved composite solid propellants of this invention comprise a binder, ammonium perchlorate oxidizer and at least one bitetrazole compound.

The binder materials which may be employed in the practice of this invention are conventional materials known in the art. Illustrative of such binder materials are hydroxy-, carboxy- or epoxy-terminated polybutadienes; copolymers of butadiene and acrylic acid; copolymers of butadiene, acrylic acid and acrylonitrile; asphalts and pitches including natural asphalt having a softening point of about 170° F., air blown asphalt having a softening point of about 270° F., mixtures of asphalt and synthetic or natural rubber, pitch having a softening point of about 240° F. and mixtures of pitch and rubber; epoxy resins; other liquid polymers such as polybutene, polyisobutylene, polycaprolactone, polyethylene glycol, and polysulfide polymers; polyethylene; natural and synthetic rubbers such as butyl rubber; natural and synthetic waxes having melting points within the range of about 200° F. to about 250° F.; synthetic resins and plastics such as the various acrylic and polyvinyl resins; and nitro polymers such as polynitromethylmethacrylate, nitropolybutadiene and polynitrovinyl alcohols. The preferred binders are hydroxy-terminated polybutadiene, carboxy-terminated copolymers of butadiene and acrylic acid and carboxy-terminated terpolymers of butadiene, acrylic acid and acrylonitrile.

Where required, conventional curing agents may be employed to effect cure of the binder. For example, polyfunctional isocyanates may be employed to cure hydroxyor epoxy-terminated resins, and polyfunctional aziridines, epoxides, and combinations thereof readily effect cure of carboxyl terminated resins. The selection of the particular curing agent and the amount employed will, of course, depend upon the particular resins employed, the desired curing time and conditions and the final physical properties desired for the propellant. Generally, however, an amount of curing agent up to about 15% by weight based on the total weight of the binder will be sufficient to effect curing.

The binder may also include various compounding ingredients. These ingredients include, but are not limited to, a plasticizer such as dioctyl adipate which improves the castability of the uncured propellant and modifies the mechanical properties of the cured propellant, a bonding agent such as TEPANOL (the reaction product of tetraethylenepentamine, acrylonitrile and glycidol) and a cure catalyst such as triphenyl bismuth. As used herein, the term "binder" is intended to include the binder resin, the resin curing agent, if one is employed, and the various compounding ingredients which may be employed. The composite solid propellants of this invention will normally contain from about 8% to about 24% by weight binder based on the total weight of the composite solid propellant.

The oxidizer employed in the composite solid propellants of this invention is preferrably ammonium perchlorate (AP), although cyclotetramethylenetetranitramine (HMX) may be used as part of the oxidizer up to about 20% by weight based on the total weight of the composite solid propellant. Typically, the AP particle size range used in the composite solid propellant is between about 1 and about 400 microns average particle size, preferably between about 70 and about 400 microns. The amount of oxidizer used in the propellant is usually a major amount of the total propellant composition and is generally in the range of about 50% to about 85% by weight based on the total weight of the composite solid propellant.

In accordance with this invention, the composite solid propellants contain at least one bitetrazole compound. As used herein, the term "bitetrazole compound" means bitetrazole itself as described in U.S. Pat. No. 4,142,029 formula IV and the diammonium salt of bitetrazole. These compounds are represented by the following formulas I and II:

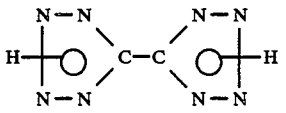

(I)

Bitetrazole

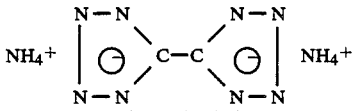

(II)

Diammonium Salt of Bitetrazole

The bitetrazole compounds are employed in particulate form having particle sizes up to about 170 microns average longest dimension, with the preferred particle size being less than 44 microns average longest dimension. In general, the smaller the bitetrazole particle sizes the more effective it is.

The bitetrazole compounds may be employed in any amount which is effective to reduce the burning rate of the propellant without significantly effecting its other properties. In general, the bitetrazole compounds may be employed in amounts from about 0.5% to about 5.0%, preferably from about 0.5% to about 2.0%, by weight based on the weight of the propellant.

Metallic fuel, such as for example, finely divided aluminum or magnesium, may optionally be employed in the composite solid propellants of this invention. When employed, the fuels are present in the composite solid propellants of this invention in amounts from about 1% to about 25% by weight based on the total weight of the composite solid propellant.

The composite solid propellants of this invention may be prepared by conventional techniques. For example, the binder components may be mixed together (except that the curing agent may be withheld until after all other components are mixed) and then the metallic fuel and finely divided bitetrazole compound may be mixed with the binder followed by addition of the oxidizer. The propellant containing the bitetrazole compound is prepared in the same manner as a propellant without it except for the addition of the bitetrazole at some point where it can be dispersed thoroughly.

The following examples further illustrate this invention, but are not intended to limit it in any manner. Unless otherwise indicated, all parts and percentages are by weight.

EXAMPLE 1

Propellants with and without bitetrazole are prepared having the following formulations:

| Material | No. 1 | No. 2 |
|---|---|---|
| Hydroxy-terminated polybutadiene polymer* | 7.24 | 7.24 |
| Tepanol** (the reaction product of tetraethylenepentamine, acrylonitrile and glycidol) | 0.15 | 0.15 |
| Dioctyl Adipate | 2.00 | 2.00 |
| Aluminum Powder | 21.00 | 21.00 |
| Bitetrazole*** | — | 2.00 |
| Ammonium Perchlorate (400 micron) | 17.10 | 16.50 |
| Ammonium Perchlorate (180 micron) | 34.20 | 33.00 |
| Ammonium Perchlorate (70 micron) | 5.70 | 5.50 |
| Octadecyl Isocyanate | 0.04 | 0.04 |
| HMX | 12.00 | 12.00 |
| Isophorone Diisocyante | 0.57 | 0.57 |

*R-45M, Arco Chemical Company
**HX-878, 3M Company
***Bitetrazole or diammonium bitetrazole of various particle sizes as indicated in Table I.

A premix is prepared by mixing the polymer, Tepanol, and dioctyl adipate followed by adding and mixing in the aluminum and bitetrazole. The AP oxidizer is added to the resulting premix and mixed in at approximately 160° F. The mixture is cooled to approximately 135° F. and the octadecyl isocyanate and HMX are added and mixed. The isophorone diisocyanate is then incorporated into the mixture to finish the propellant. Following deaeration under vacuum (20 mm Hg) the propellant is cured at approximately 135° F.

EXAMPLE 2

The propellants prepared in Example 1 are tested to determine the effects of the bitetrazole compounds on processibility, available energy, burning rate, and combustion residue slag formed. The propellants are static tested for burning rates ($r_b$) in small center perforated 1.5 in. O.D. 2.5 in. long solid propellant rocket motors. The amount of combustion slag formed is determined with the quenched particle collection bomb (QPCB) using the procedure described by Christiensen, Daugherty, and Hendrickson[1]. The processibility of the uncured propellant is determined by measuring the end-of-mix (EOM) viscosity with a Brookfield Laboratories, Inc., Model HB Viscometer. The propellant available energy or specific impulse ($I^{\circ}_{sp}$) in lb. force sec./lb. mass is calculated with the standard thermochemical computer program used throughout the solid propellant industry (NASA SP273, 1971).

The results are as follows:

TABLE I

| | Bitetrazole and Size Used in Propellant | | | | | |
|---|---|---|---|---|---|---|
| | Bitetrazole | | Diammonium Bitetrazole | | | |
| | None | 8 uWMD[2] | <44 uWMD[2] | 70 uNML[3] | 100 uNML[3] | 170 uNML[3] |
| $I^{\circ}_{sp}$ (lbf · sec/lbm)[4] | 265.7 | 265.9 | 265.7 | 265.7 | 265.7 | 265.7 |
| r b @ 1000 psi (ips) | 0.330 | 0.320 | 0.303 | 0.309 | 0.319 | 0.327 |
| QPCB Residue | | | | | | |
| 210 u (%) | 0.9 | 1.3 | 0.6 | 1.5 | 1.4 | 2.5 |
| 150 u (%) | | | 2.7 | | 3.1 | 4.0 |
| 75 u (%) | | | 6.8 | | 6.0 | 7.0 |
| EOM Viscosity | 6.4 @ 136 | 7.5 @ 141 | 5.4 @ 141 | 7.0 @ 137 | 4.8 @ 145 | 7.7 @ 136 |

TABLE I-continued

| | Bitetrazole and Size Used in Propellant | | | | | |
|---|---|---|---|---|---|---|
| | Bitetrazole | | Diammonium Bitetrazole | | | |
| | None | 8 uWMD[2] | <44 uWMD[2] | 70 uNML[3] | 100 uNML[3] | 170 uNML[3] |
| (kps @ °F.) | | | | | | |

[2]WMD = weight mean diameter
[3]NML = number mean length
[4]$I^{*}_{sp}$ at 1000 psi chamber pressure, sea level atmosphere and optimum nozzle expansion ratio These data demonstrate that the replacement of 2% AP in the propellant composition does not decrease the available energy nor make the propellant significantly more difficult to mix. The reduction in burning rate achieved with the bitetrazole compounds is dependent on particle size; fine is best. An 8% decrease in burning rate results from use of 2% diammonium bitetrazole<4-4uWMD. The amount of combustion residue slag does not change appreciably with the addition of the bitetrazoles to the propellant, especially the finer particle sizes.

I claim:

1. In a composite solid propellant containing ammonium perchlorate as oxidizer, the improvement comprising at least one bitetrazole compound in an amount effective to reduce the burning rate of said propellant.

2. The propellant of claim 1 wherein the bitetrazole compound is bitetrazole.

3. The propellant of claim 1 wherein the bitetrazole compound is the diammonium salt of bitetrazole.

4. The propellant of claim 1 wherein the bitetrazole compound is employed in an amount from about 0.5% to about 5.0% by weight based on the weight of the propellant.

* * * * *